US009101963B2

(12) United States Patent
Christel

(10) Patent No.: US 9,101,963 B2
(45) Date of Patent: Aug. 11, 2015

(54) DEVICE AND METHOD FOR SORTING POLYMERIC MATERIAL

(71) Applicant: Bühler Thermal Processes AG, Oberbüren (CH)

(72) Inventor: Andreas Christel, Zuzwil (CH)

(73) Assignee: Polymetrix AG, Oberbüren (CH)

( * ) Notice: Subject to any disclaimer, the term of this patent is extended or adjusted under 35 U.S.C. 154(b) by 49 days.

(21) Appl. No.: 13/956,930

(22) Filed: Aug. 1, 2013

(65) Prior Publication Data

US 2014/0054204 A1 Feb. 27, 2014

(30) Foreign Application Priority Data

Aug. 24, 2012 (EP) ..... 12181648

(51) Int. Cl.
*B65H 5/36* (2006.01)
*B07C 5/342* (2006.01)
*B07C 5/36* (2006.01)

(52) U.S. Cl.
CPC ..... *B07C 5/3425* (2013.01); *B07C 5/36* (2013.01)

(58) Field of Classification Search
CPC ..... B65H 5/36; B65H 5/3425
USPC ..... 209/576, 577, 580, 587, 644
See application file for complete search history.

(56) References Cited

U.S. PATENT DOCUMENTS

| | | | | |
|---|---|---|---|---|
| 5,316,222 | A * | 5/1994 | Kanda et al. | 241/5 |
| RE36,537 | E * | 2/2000 | Sommer, Jr. et al. | 209/576 |
| 6,056,127 | A * | 5/2000 | Low et al. | 209/639 |
| 6,651,818 | B1 * | 11/2003 | Ilmasti et al. | 209/12.2 |
| 7,355,140 | B1 * | 4/2008 | Afsari | 209/580 |
| 2010/0096299 | A1 * | 4/2010 | Adams et al. | 209/577 |
| 2010/0230330 | A1 | 9/2010 | Afsari et al. | |
| 2012/0256022 | A1 * | 10/2012 | Box et al. | 241/24.1 |
| 2014/0255694 | A1 * | 9/2014 | Bakke et al. | 428/402 |

FOREIGN PATENT DOCUMENTS

EP 1273359 1/2003

* cited by examiner

*Primary Examiner* — Patrick Cicchino
(74) *Attorney, Agent, or Firm* — Davis & Bujold, P.L.L.C.; Michael J. Bujold

(57) ABSTRACT

A device for obtaining a material from a mixed fraction (including particles of a desired material and particles of another material with different optical properties) has a first sorting apparatus and at least two further sorting apparatuses below the first sorting apparatus. From the first sorting apparatus, a major fraction is introduced into a first further sorting apparatus and purified further there, while a minor fraction is passed into a second further sorting apparatus and processed further there.

19 Claims, 7 Drawing Sheets

DEVICE AND METHOD FOR SORTING POLYMERIC MATERIAL

The present invention relates to a device and a method for sorting polymeric material, such as e.g. polyethylene terephthalate, polyethylene or polypropylene.

These days, a number of commodities such as drinks bottles, films or other packaging are made of polymeric materials. In an exemplary fashion, reference is made to PET bottles, which are made of polyethylene terephthalate (PET). Here, a polyethylene terephthalate prepolymer is produced from the terephthalic acid and ethylene glycol monomers via melt polycondensation and subsequently increased to the desired molecular weight by solid state postcondensation (SSP) The production of PET is known and, for example, described in detail in the handbook "Modern Polyesters" (Scheirs/Long (eds.), Wiley 2003, particularly pp. 31-104 and 143-186).

It is mainly for ecological aspects that such polymeric materials are recycled these days on a large scale. PET is very well suited to recycling because it can be reprocessed a number of times. Recycling loops have been established, which comprise the collection of used PET bottles, the separation thereof from other rubbish and reprocessing. The polymeric material is ground to form flakes and separated from foreign materials. In general, the molecular weight of the PET flakes obtained thus must be increased again within the scope of an SSP reaction in order to compensate for the material degradation occurring during use and the above-described recycling.

In respect of the reusability of the polymeric material, it is important to recover same in a pure form. In addition to separating the polymeric material from foreign materials, it is also necessary to separate differently coloured fractions of the polymeric material from one another in a precise fashion.

In principle, a separation can be brought about with the aid of known sorting machines. Thus, Bühler Sortex Ltd. has disclosed sorting machines, by means of which particles can, inter alia, be separated on the basis of different colouring. These sorting machines are described in e.g. U.S. Pat. Nos. 4,203,522, 4,513,868, 4,699,273, 5,538,142, WO 98/18573, EP-0 838 274 A2 or WO 2010/073004 A1.

In these sorting machines, the product to be separated, in particle form, is introduced in continuous and uniform fashion from a metering system into the actual sorting station via a slide, with the particles passing through said sorting station in free fall. The particles are tested e.g. optically in the sorting station. To this end, suitable electromagnetic radiation is shone at the particles, the radiation reflected by the particles or, alternatively, the transmission radiation passing through the particles being detected and evaluated in a data processing installation. Depending on the obtained signal, which corresponds to the type of particle, the particle either subsequently falls into a first container or the signal activates a separation device such as e.g. an outlet system, which deflects the corresponding particle by a puff of air from a nozzle and transfers it into a second container.

These sorting machines, which were originally developed for foodstuff such as rice, are very efficient and can, depending on the product to be separated, achieve throughput performances of up to 32 t/h. In the case of separating polymeric particles, these sorting machines achieve throughput performances of 0.5 to 12 t/h.

It was found that the known sorting machines cannot achieve a degree of purity required for various applications of recycled polymer or too much waste is generated, which is economically disadvantageous.

Hence, it was the object of the present invention to provide a device and a method for an even more efficient separation of polymeric particles.

According to the invention, the present object is achieved by a device and a method as described below.

In particular, the present invention relates to a device for obtaining a material from a mixed fraction, which comprises particles of the desired material and particles of at least one further material with different optical properties than the desired material, said device comprising a first sorting apparatus with at least two outlet openings for particles separated from one another, characterized in that at least two further sorting apparatuses with at least two outlet openings for particles separated from one another are located downstream of the first sorting apparatus, wherein an outlet opening, of the first sorting apparatus, for receiving a major fraction is connected to the inlet opening of a first further sorting apparatus, an outlet opening, of the first sorting apparatus, for receiving a minor fraction is connected to the inlet opening of a second further sorting apparatus, an outlet opening, of a first further sorting apparatus, for receiving a minor fraction is connected to the inlet opening of the first sorting apparatus and an outlet opening, of a second further sorting apparatus, for receiving a major fraction is connected to the inlet opening of the first sorting apparatus.

The present invention furthermore relates to a method for obtaining a material from a mixed fraction, which has particles of the desired material and particles of at least one further material with different optical properties than the desired. material, preferably in a device as described above, said method comprising the following steps:

a) removing particles of the further material from particles of the desired material in a first sorting apparatus, obtaining a major fraction and a minor fraction in the process;
b) transferring the major fraction into a first further sorting apparatus and transferring the minor fraction into a second further sorting apparatus;
c) removing particles of the further material from particles of the desired material in a first further sorting apparatus, obtaining a second major fraction and a second minor fraction in the process;
d) removing particles of the further material from particles of the desired material in a second further sorting apparatus, obtaining a third major fraction and a third minor fraction in the process;
e) returning the second minor fraction and the third major fraction to the mixed fraction or directly transferring these fractions into the first sorting apparatus.

According to the present invention, "located downstream" should be understood to mean that one sorting apparatus, in operational terms, follows another sorting apparatus such that it takes up a fraction of the particles separated by the other sorting apparatus and subjects it to further treatment. Here, the two sorting apparatuses can be arranged above one another or next to one another, or the one sorting apparatus can be arranged in front of or behind the other sorting apparatus.

According to the present invention, "major fraction" should be understood to mean a particle stream leaving a sorting apparatus, in which particle stream the desired particles are enriched compared to the mixed fraction which was introduced into the sorting apparatus, i.e. the particle stream has a lower number of particles of at least one further material. By way of example, the major fraction can have 95% desired material and 3% undesired material, starting from a mixed fraction of 70% desired material, and 30% undesired material.

According to the present invention, "minor fraction" should be understood to mean a particle stream leaving a sorting apparatus, in which particle stream the desired particles are depleted compared to the mixed fraction which was introduced into the sorting apparatus, i.e. the particle stream has a lower number of particles of the desired material. However, it is possible for the plurality of the particles in the minor fraction to be particles of the desired material. By war of example, the minor fraction can have 60% desired material and 40% undesired material, starting from a mixed fraction of 70% desired material and 30% undesired material.

According to the invention, the purity of the major fraction, which is ultimately extracted from the device as desired product, is increased in an efficient and economical fashion by virtue of minor fractions mainly comprising particles of at least one further material being removed in a plurality of sorting apparatuses arranged behind one another in series. As a result of the multiple separations, the purity of the major fraction is increased. However, the minor fractions obtained thus are not discarded at the same time, but rather are subjected to further separation processes, with a uniform load on the various sorting apparatuses being ensured by the inventive guidance of the particle streams. As a result of this, the yield of major fraction can be increased because desired material present in the minor fractions is not discarded but rather returned to the process cycle and is able to be extracted as desired product.

The present invention will be explained in more detail below on the basis of non-limiting examples and figures, in which:

FIG. 1*a* shows a schematic illustration of a sorting apparatus usable according to the invention;

FIG. 1*b* shows a detailed illustration of a sorting apparatus usable according to the invention;

Figure 1A:
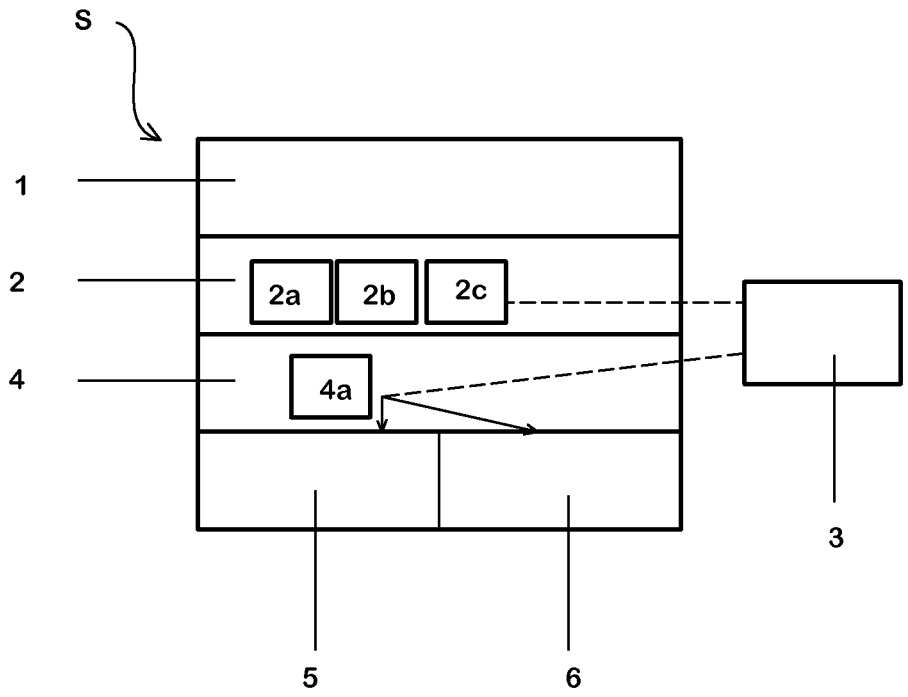

FIG. 1*a* shows the general mode of operation of a sorting apparatus usable according to the invention. However, the present invention is not restricted to such a sorting apparatus. In principle, use can be made of any apparatus for efficient separation of particles on the basis of the optical properties thereof.

The sorting apparatus S schematically shown in FIG. 1*a* comprises an inlet region 1. The inlet region has at least one inlet opening for receiving a mixed fraction to be separated (for example a cyclone with a downstream lock) and at least one acceleration device for accelerating the particles in the mixed fraction.

Additional units such as a buffer space for temporary storage of the introduced mixed fraction. and a metering device can be arranged in the inlet region 1. Metering devices for sorting apparatuses are commonly known and serve for introducing a specific quantity of a uniform particle stream into the acceleration device. Here, a vibrating chute, a conveyor worm, a conveyor belt (as described in WO 98/18573, for example) or an opening with an adjustable cross section are mentioned in an exemplary fashion. However, according to one embodiment of the present invention, an acceleration device, can be provided as a band machine, which simultaneously fulfils the function of a metering device. In other words, the metering device and the acceleration device are the same device in this embodiment.

In the acceleration device, a fixed speed is imparted onto the particles to be separated, with which speed the particles, as uniform product stream, subsequently pass through the detection region 2 in free-fall. Acceleration devices for sorting apparatuses are commonly known. Here, a tilted chute, a slide, a conveyor belt (for example a conveyor belt tilted by 60° as described in WO 98/18573) or a drop distance are mentioned here in an exemplary fashion.

The accelerated particles enter the detection region 2. In the detection region 2, the particles are subjected to electromagnetic radiation from at least one radiation source 2*a*. Depending on the optical property to be determined, these can be radiation sources which emit light in the wavelength range between 10 and 10 000 nm, i.e. in the visible region of the electromagnetic spectrum, in the ultraviolet (UV) region of the electromagnetic spectrum or in the infrared (IR) region of the electromagnetic spectrum or in a plurality of these regions. Suitable radiation sources for sorting apparatuses are commonly known. Halogen lamps which emit a broad spectrum of electromagnetic radiation from the visible region to the near infrared region. (SWIR), i.e. over a wavelength range of 400 to 2000 nm, may be mentioned in an exemplary fashion. It is also possible to combine a plurality of radiation sources with different emission spectra.

The electromagnetic radiation reflected by the particles or, alternatively, the transmission radiation passing through the particles, is detected with the aid of at least one detector 2*c*. Suitable detectors for sorting apparatuses are commonly known. Camera units with detectors for visible light or detectors for SWIR light such as InGaAs detectors and optionally with beamsplitters such as prisms or mirrors may be mentioned in an exemplary fashion. In this respect, reference may be made to the content of WO 2010/073004, with reference being made to the corresponding contents thereof. Depending on the application, one or more of such detectors 2*c*, either of the same type or of different types, can be present in the sorting apparatus S.

According to a preferred embodiment, a filter can be arranged between radiation source 2*a* and detector 2*c* so that only selective radiation reaches the detector 2*c* and is captured by the latter. A person skilled in the art is commonly aware of suitable filters.

The particles subsequently leave the detection region 2 through a product passage 2*b* (a suitable opening), while the at least one detector 2*c* transmits the captured radiation in the form of a signal to a data processing unit 3. In the data processing unit 3, the incoming signal is evaluated and converted into a separation command. Suitable data processing units for sorting apparatuses are commonly known. By way of example, depending on the degree of colouring of the particles, a specific threshold of radiation reflected by the particle is exceeded. and the particle is classified as unsuitable. The data processing unit 3 then generates a separation command and thereby triggers the function of a deflection device 4*a*.

The deflection device 4*a* is arranged in the separation region 4. The particles passing through the product passage 2*b* reach the separation region and pass the deflection device. If no separation command has been triggered, the deflection device remains inoperative and the particles, without changing paths, directly reach the outlet opening 5 for a major fraction, which mainly comprises particles of the desired material. By contrast, if a separation command was triggered, the deflection device 4*a* receives the corresponding command from the data processing installation 3 and deflects the particle passing the deflection device 4*a* such that said particle reaches the outlet opening 6 for a minor fraction, which mainly comprises particles of the further material.

The deflection device 4*a* can be a mechanical or a pneumatic device. Use is preferably made of a pneumatic deflection device. By way of example, the latter comprises an elongated pipe with a multiplicity of separately operable air nozzles, which are affixed along the pipe. Pressurized air is conducted through the pipe. After obtaining a separation command, a corresponding nozzle is activated and emits a puff of air onto the passing particle, which is deflected as desired as a result thereof.

The sorting apparatuses usable according to the invention therefore have two outlet openings. The outlet opening 5 for receiving the major fraction, i.e. the particle stream in which the desired particles are enriched compared to the mixed fraction which was introduced into the sorting apparatus, is operatively connected to the product passage 2*b* (i.e. there is no direct connection between product passage 2*b* and outlet opening 5) in such a way that the particles reach this outlet opening 5 from the product passage 2*b* when the deflection device 4*a* is inactive. By way of example, the outlet opening 5 for receiving the major fraction can be arranged directly below the product passage 2*b* in the free-fall line therefrom, such that the particles reach this outlet opening 5 in free fall directly from the product passage 2*b*.

The outlet opening 6 for receiving the minor fraction, i.e. the particle stream in which the desired particles are depleted compared to the mixed fraction which was introduced into the sorting apparatus, is operatively connected to the product passage 2*b* (i.e. there is no direct connection between product passage 2*b* and outlet opening 6) in such a way that the particles only reach this outlet opening 6 from the product passage 2*b* if the deflection device 4*a* is active and deflects the particles into the outlet opening 6. By way of example, the outlet opening 6 for receiving the minor fraction can be arranged below the product passage 2*b* offset from the free-fall line therefrom, such that the particles do not reach this outlet opening 6 in free fall from the product passage 2*b*. Rather, the outlet opening 6 in this case is on a trajectory that the particles assume when they are deflected from the free-fall trajectory by the deflection device 4*a*.

The sorting apparatuses present in the device according to the invention are all designed according to the aforementioned principle, but may optionally differ in terms of details, for example in the type and number of the utilized radiation sources, detectors, acceleration devices, etc.

According to the invention, it is preferred if all sorting apparatuses present in the device have an identical design.

Figure 1B:
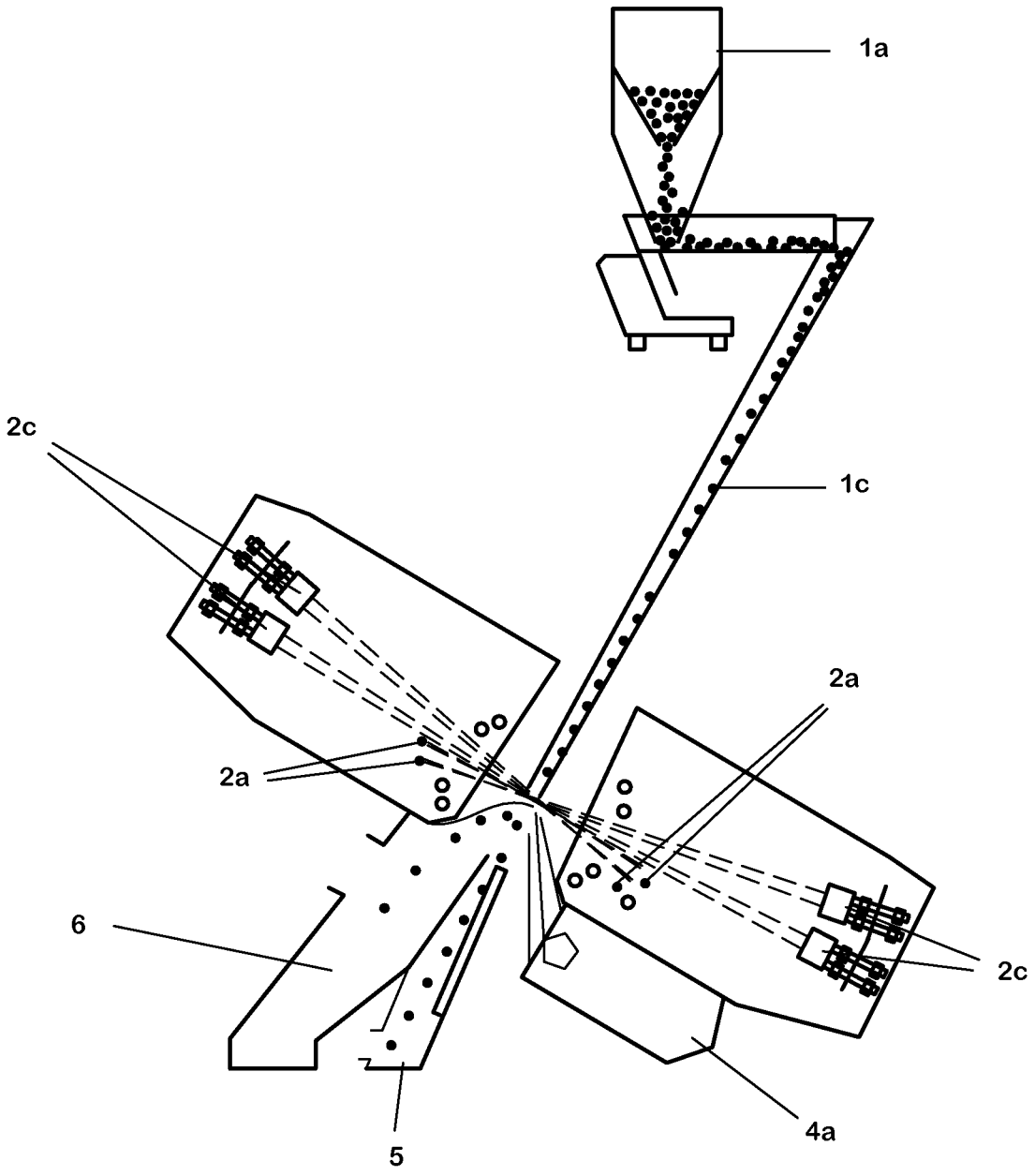

FIG. 1*b* shows a detailed illustration of a sorting apparatus usable according to the invention. Here, this is a schematic illustration of a commercially available sorting apparatus (Sortex A from Bühler Sortex Ltd.). The sorting apparatus has a metering funnel 1*a*, into which the material to be separated is filled and uniformly brought onto a vibration chute 1*b*. With the aid of the vibration chute 1*b*, the material is conveyed onto a chute 1*c* tilted at approximately 60° and accelerated there. The particles pass through a detection region in free fall, with a total of 4 radiation sources 2*a* and a total of 4 detectors (cameras) 2*c*) being arranged in the latter. A high-speed emission device 4*a* applies a puff of air to the falling particles depending on a separation command being obtained from a data processing device (not shown in FIG. 1*b*) and drives the particles, which would otherwise fall into the outlet opening 5 for the major fraction, into the outlet opening 6 for the minor fraction.

According to the present invention, even more efficient and more economic purification of polymeric material can be achieved with a device as shown schematically in one of FIGS. 2 to 5. The present invention is not restricted to the embodiments shown there, although these are currently the most favoured ones when taking into account all aspects such as efficiency, costs, complexity, etc.

Figure 2:
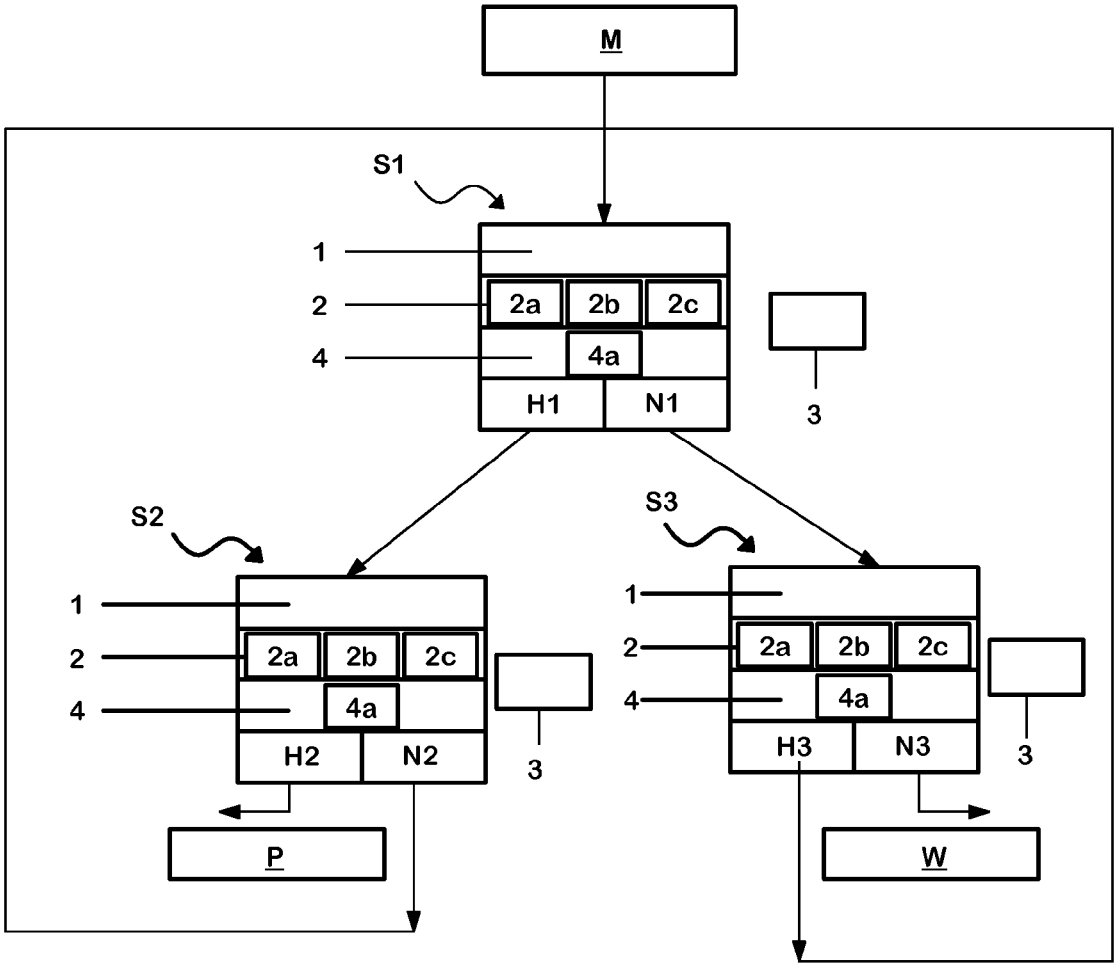
FIG. 2 shows a first embodiment of the present invention.

FIG. 2 explains the basic principle of the present invention. In a first sorting device S1, the mixed fraction M, which contains the desired material, is separated into a first major fraction H1 and a first minor fraction N1. The design of the first sorting device S1 corresponds to the design of the sorting device S shown in FIG. 1, with the same reference signs in the figures having the same meaning.

The first major fraction H1 is now subjected to additional purification in a first further sorting device S2. The design of the first further sorting device S2 corresponds to the design of the sorting device S shown in FIG. 1, with the same reference signs in the figures having the same meaning.

Transferring the particles from one sorting device into another sorting device can be brought about in a known fashion, for example with the aid of a pipe through which the particles can be conveyed with the aid of a gas, or with the aid of a conveyor belt, a conveyor worm or a vibrating chute. When transferring the particles from one sorting device into another sorting device, any risk of contamination should, as a matter of principle, be excluded to the greatest possible extent.

In the first further sorting device S2 there is an analogous second removal, as described above, of undesired particles in the form of a second minor fraction N2 from the major fraction H1. The further purified major fraction H2 can be extracted from the device according to the invention as desired product P.

The second minor fraction N2, which is generated in the first further sorting device S2, is not discarded as waste. After all, these are particles which were accepted during the first separation process in the device S1 and assigned to the major fraction H1. Rather, the second minor fraction N2 is returned to the first sorting device S1.

According to the present invention, the second minor fraction N2 may be unified with the mixed fraction M prior to the entry of the former into the first sorting device S1, i.e. the mixed fraction M and the second minor fraction N2 feeds should be unified prior to the entry into the first sorting device S1. However, according to the invention, both fractions (mixed fraction M and second minor fraction N2) are preferably brought together in a buffer space in the inlet region 1 of the first sorting device S1. In this case, the mixed fraction M and the second minor fraction N2 are routed into the corresponding buffer space through separate inlet openings (e.g. cyclones with downstream locks), in which buffer space these streams are unified and together routed into the further sections of the sorting apparatus S1.

The first minor fraction N1, which is generated in the first sorting device S1, is also not discarded as waste. Rather, the first minor fraction N1 is transferred to the second further sorting device S3. The design of the second further sorting device S3 corresponds to the design of the sorting device S shown in FIG. 1, with the same reference signs in the figures having the same meaning.

The first minor fraction N1 is subjected to purification in the second further sorting device S3. The purification is brought about as described above by removing a third minor fraction N3 from the first minor fraction N1. However, the purified third major fraction H3 obtained thus is not pure enough for being able to be extracted from the device according to the invention as desired product. The third major fraction H3 is therefore returned to the first sorting device S1.

According to the present invention, the third major fraction H3 may be unified with the mixed fraction M prior to the entry of the former into the first sorting device S1, i.e. the mixed fraction M and the third major fraction H3 feeds should be unified prior to the entry into the first sorting device S1. By way of example, the feeds of the mixed fraction M, the second minor fraction N2 and the third major fraction H3 unify at a point in front of the inlet opening of the first sorting device S1. However, according to the invention, all fractions (mixed fraction M, second minor fraction N2 and third major fraction H3) are preferably brought together in a buffer space in the inlet region 1 at the first sorting device S1. In this case, the mixed fraction M, second minor fraction N2 and third major fraction H3 are routed into the corresponding buffer space through separate inlet openings (e.g. cyclones with downstream locks), in which buffer space these streams are unified and together routed into the further sections of the sorting apparatus S1.

So much of the desired product has been removed from the third minor fraction N3, which is generated in the second further sorting device S3, that further processing thereof is no longer worthwhile. It is discarded as waste W.

The device according to FIG. 2 firstly achieves a higher degree of purity of the major fraction H2, extracted as product, because the latter is obtained after two-fold removal (and not only single separation as in the prior art) of undesired particles. Secondly, the method operated with this device is more economical because the minor fractions N1 and N2 are not discarded as waste but rather returned into the method cycle for further processing. Only the depleted third minor fraction N3 obtained after two separation treatments is discarded as waste W. As a result of this, significantly less waste is generated in the device according to the invention and more valuable polymeric material is obtained for further processing.

Figure 3:
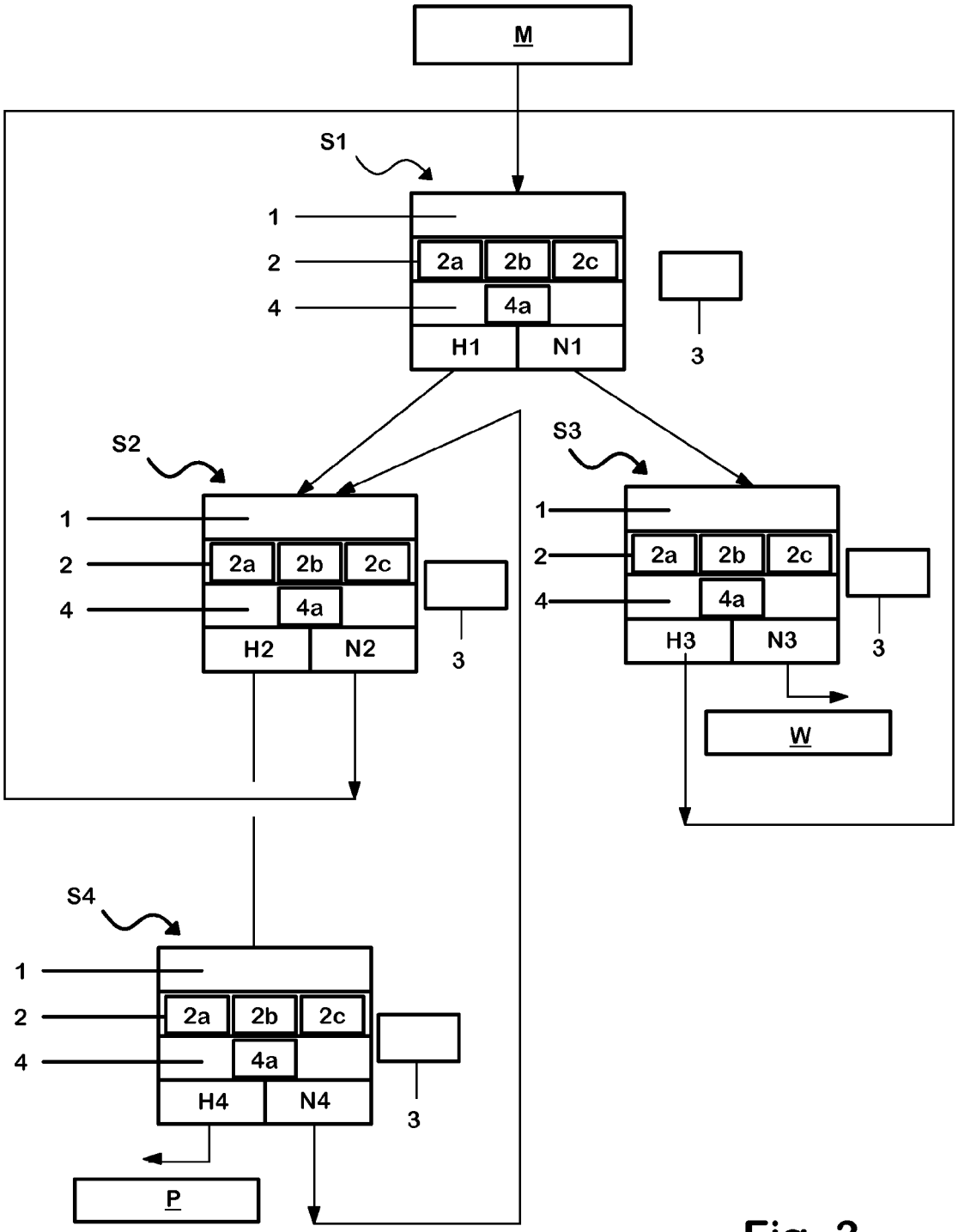
FIG. 3 shows a second embodiment of the present invention.

An even greater degree of purification of the desired product P can be achieved, with a device according to the embodiment shown in FIG. 3. In contrast to the embodiment according to FIG. 2, the second major fraction H2 is riot extracted from the device as desired product, but rather it is fed to a third further sorting device S4. The transfer of the particles from one sorting device into another sorting device can also be brought about in a known fashion in the embodiment according to FIG. 3, for example with the aid of a pipe through which the particles can be conveyed with the aid of a gas, or with the aid of a conveyor belt, a conveyor worm or a vibrating chute. When transferring the particles from one sorting device into another sorting device, any risk of contamination should, as a matter of principle, be excluded to the greatest possible extent.

In the third further sorting device S4 there is an analogous third removal, as described above, of undesired particles in the form of a fourth minor fraction N4. The further purified fourth major fraction H4 can be extracted from the device according to the invention as desired product P.

The fourth minor fraction N4, which accumulates in the third further sorting device S4, is not discarded as waste. After all, these are particles which were accepted during the earlier separation processes in the devices S1 and S2, and assigned to the major fraction H1 and H2 respectively. Rather, the fourth minor fraction N4 is returned to the first further sorting device S2.

According to the present invention, the fourth minor fraction N4 may be unified with the first major fraction H1 prior to the entry of the former into the first further sorting device S2, i.e. the first major fraction H1 and the fourth minor fraction N4 feeds should be unified prior to the entry into the first further sorting device S2. However, according to the invention, both fractions (first major fraction H1 and fourth minor fraction N4) are preferably brought together in a buffer space in the inlet region 1 of the first further sorting device S2. In this case, the first major fraction H1 and fourth minor fraction N4 are routed into the corresponding buffer space through separate inlet openings (e.g. cyclones with downstream locks), in which buffer space these streams are unified and together routed into the further sections of the first further sorting device S2.

Figure 4:
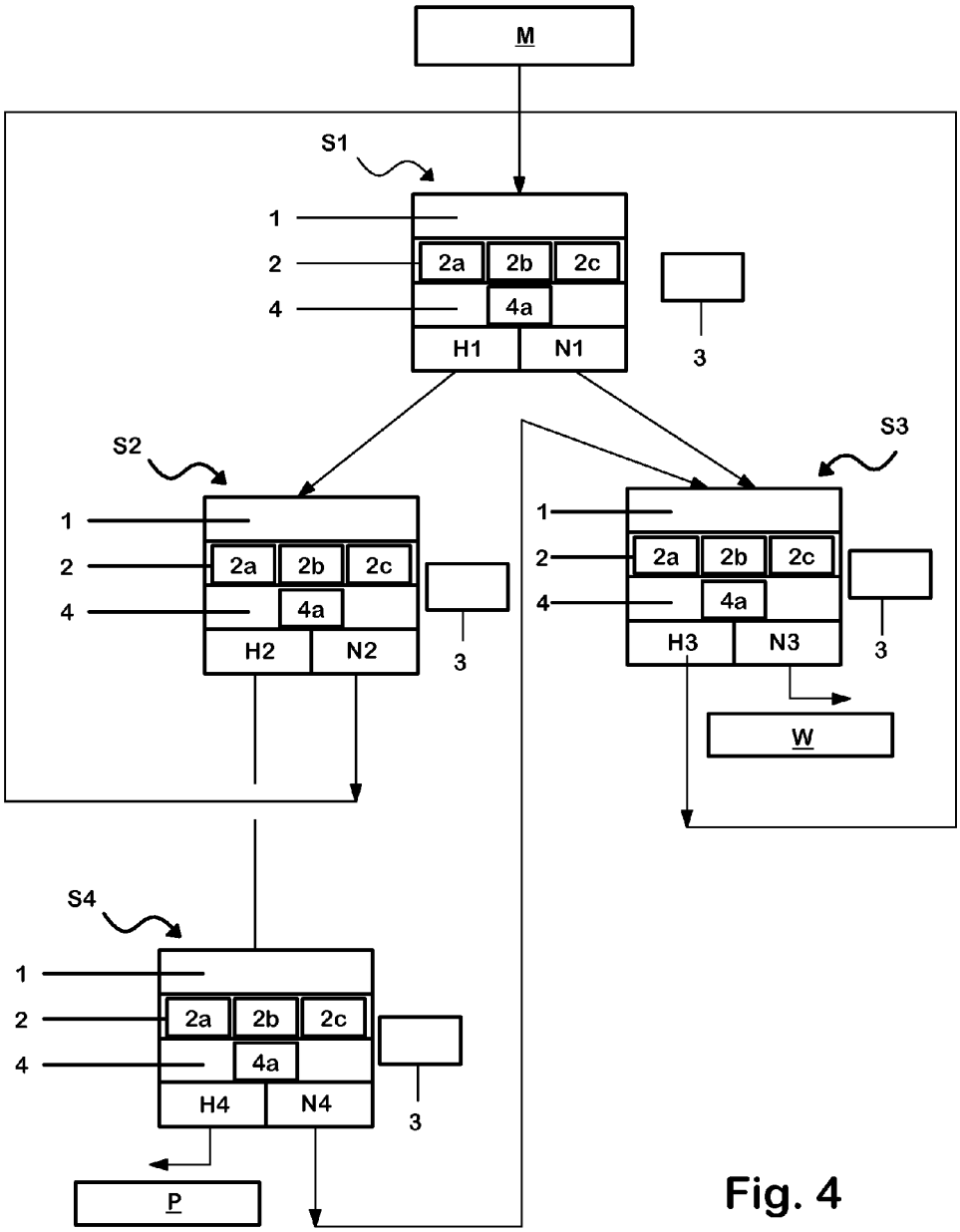
FIG. 4 shows a third embodiment of the present invention.

An alternative embodiment of the device according to FIG. 3 is shown in FIG. 4. Here, the fourth minor fraction N4 is not returned into the first further sorting device S2, but rather into the second further sorting device S3. This leads to an even higher degree of purity of the generated product P because even particles that were accepted in two separation processes are not fed into the path of the major fraction, but rather are subjected to renewed processing in at least four sorting devices (S3, S1, S2 and S4) before they can reach the fraction of the desired product P. In respect of transferring the particles from one sorting device into another sorting device and in respect of introducing the fractions into the respective sorting devices, reference is made to the explanations above in respect of the variants according to FIGS. 2 and 3.

Figure 5:
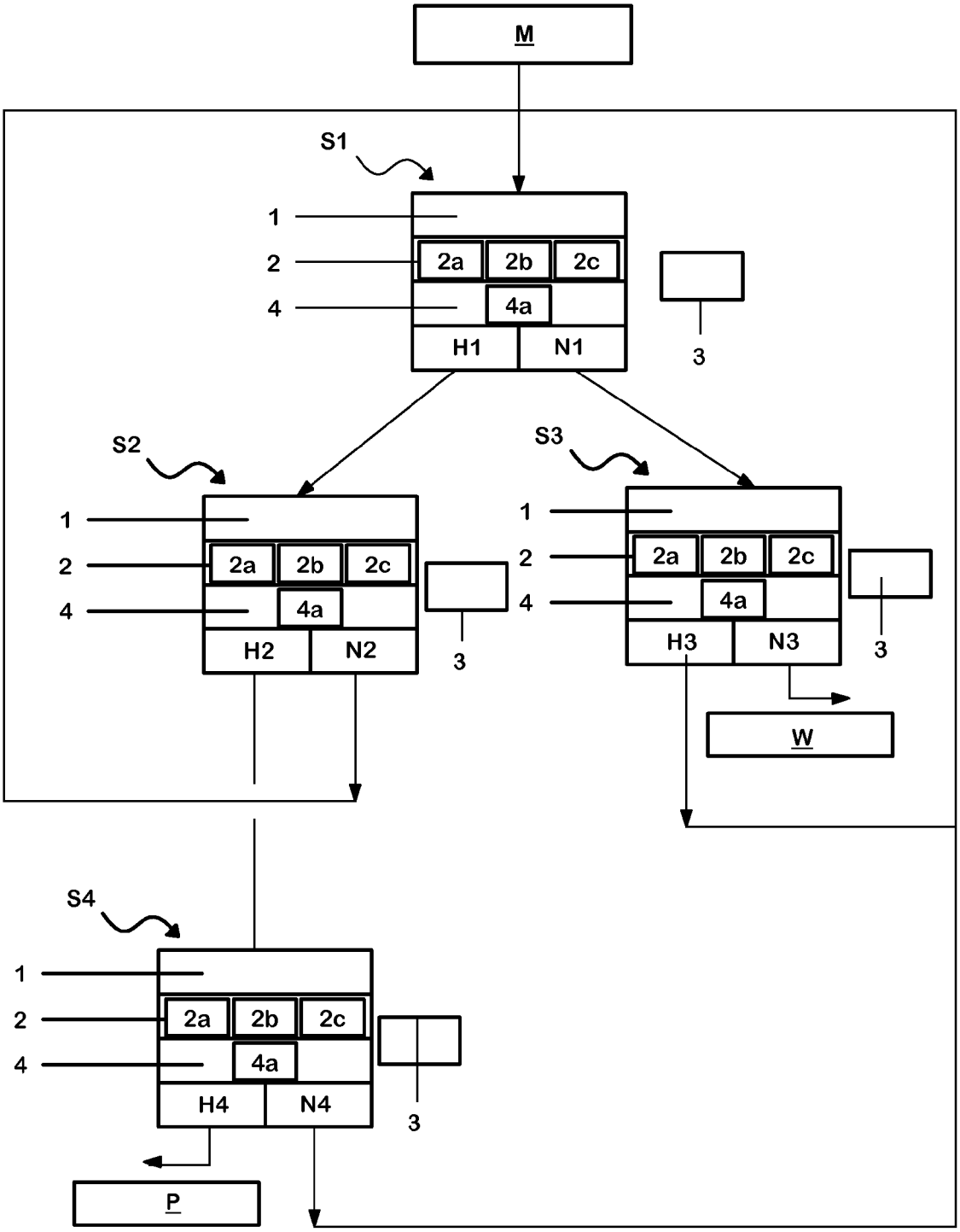
FIG. 5 shows a fourth embodiment of the present invention.

Another alternative embodiment of the device according to FIG. 3 is shown in FIG. 5. Here, the fourth minor fraction N4 is not returned into the first further sorting device S2 or into the second further sorting device S3, but rather into the first sorting device S1. This likewise leads to an even higher degree of purity of the accumulating product P because even particles that were accepted in two separation processes are not fed into the path of the major fraction, but rather are subjected to renewed processing in at least three sorting devices (S1, S2 and S4) before they can reach the fraction of the desired product P. In respect of transferring the particles from one sorting device into another sorting device and in respect of introducing the fractions into the respective sorting devices, reference is made to the explanations above in respect of the variants according to FIGS. 2 and 3.

Figure 6:
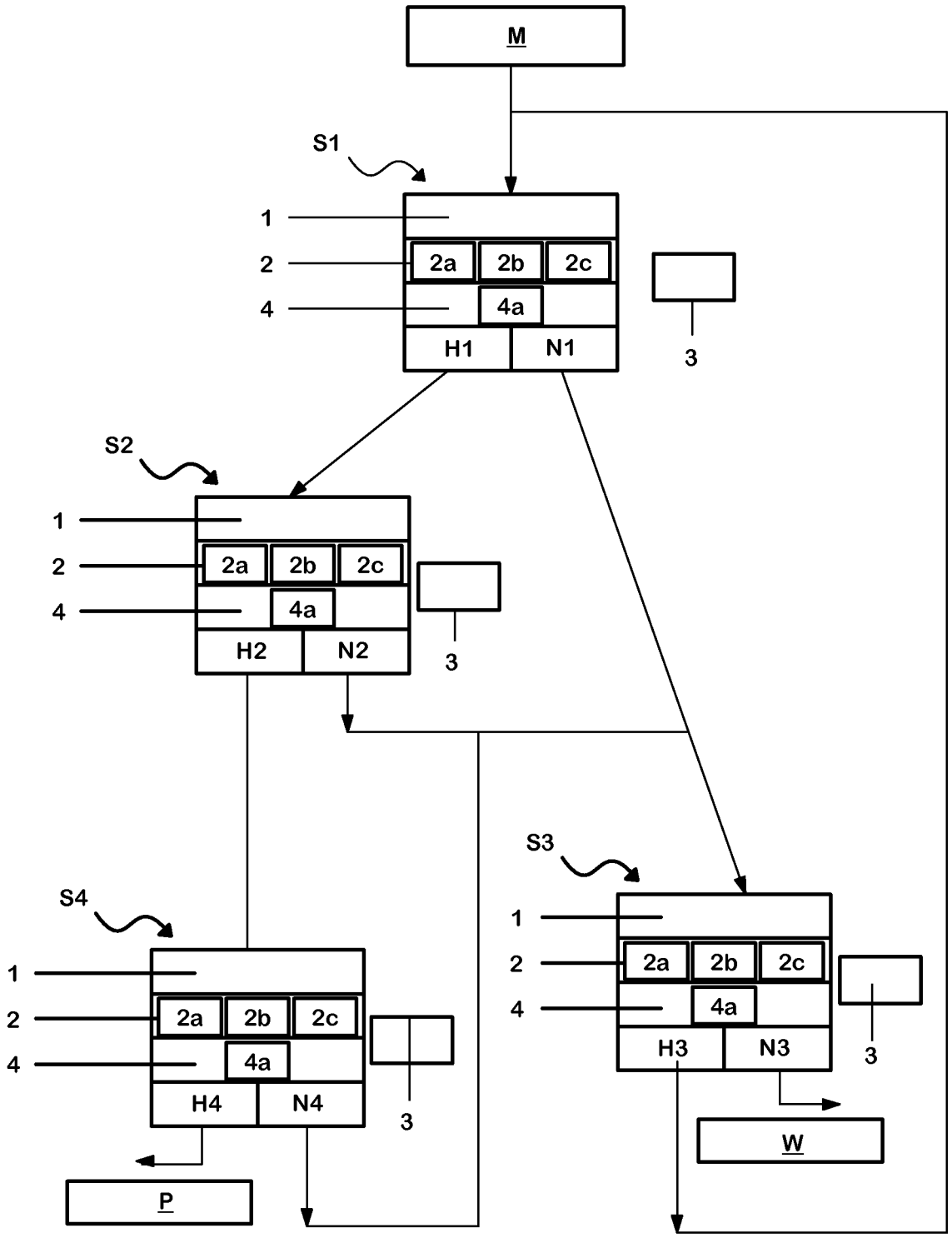
FIG. 6 shows a non-inventive embodiment of a sorting device.

FIG. 6 shows a non-inventive embodiment of a sorting device. The embodiment according to FIG. 6 differs from the embodiment according to the invention according to FIG. 3 by virtue of the fact that the outlet opening of the first further sorting apparatus (S2) for receiving a minor fraction (N2) is not connected to the inlet opening of the first sorting apparatus (S1) and that, furthermore, the outlet opening of the third further sorting apparatus (S4) for receiving a minor fraction (N4) is not connected to the inlet opening of the first further sorting apparatus (S2). Rather, in the embodiment according to FIG. 6, the outlet openings of the sorting apparatuses (S1, S2, S4) which serve for receiving minor fractions (N1, N2, N4) are connected to the inlet opening of the second further sorting apparatus (S3). Hence, all minor fractions are transferred into the second further sorting apparatus (S3). The minor fraction (N3) of the second further sorting apparatus (S3) is discarded as waste (W), while the major fraction (H3) of the second further sorting apparatus (S3) is returned into the first sorting apparatus (S1).

As shown below on the basis of the examples and comparative examples, the non-inventive embodiment according to FIG. 6 provides worse sorting compared to an embodiment according to the invention and, as a result thereof, a greater loss of desired product is obtained.

Using the device according to the invention it is possible to purify any type of polymeric material. Thus, the present invention can be used to purify PET or polyamide material after an SSP reaction has taken place. To this end, the sorting devices may possibly need to be modified, as described in the pending patent application PCT/GB2012/000377. Reference is hereby made to the content relating thereto of said application.

However, the preferred use of the device according to the invention and of the method according to the invention lies in the recycling of polymeric material. In particular, a ground polymeric material of polyethylene (PE), polypropylene (PP) or polyethylene terephthalate (PET) or mixtures thereof is preferably used as the mixed fraction, which polymeric material is obtained from containers, films, etc. of these materials, as explained above. PET recycling is particularly preferably undertaken with the present invention, i.e. the mixed fraction M comprises PET as main component.

Here, according to the invention, it is preferable for the ground material to have been comminuted in such a way that 90% or more of the particles of the mixed fraction M have a particle size of more than 2 mm, preferably between 2.5 mm and 20 mm and particularly preferred between 2.5 mm and 16 mm.

According to the invention, preference is furthermore given to the mixed fraction M consisting of 50 to 90% particles of the desired material and 10 to 50% particles of at least one further material.

The present invention can bring about very efficient purification to such a degree that the major fraction H2, H4 extracted as desired product P from the device contains less than 1000 ppm, preferably less than 500 ppm and particularly preferred. less than 200 ppm particles of the corresponding minor fraction N2, N4. Moreover, the purification can be carried out very economically with the present invention. In the minor fraction N3, ultimately discarded as waste W, there is less than 40%, preferably less than 30% and particularly preferred less than 25% particles of the desired material. As a result of the multiple treatment of the fractions, a majority of the particles of the desired material is ultimately obtained as product P.

Using the device of the present invention it is possible to achieve analogous throughput rates as in the above-described conventional sorting devices, i.e. approximately 0.5 to 12 t/h.

The present invention can be used to carry out complicated separation processes. Examples are listed below:

- The separation of clear PET flakes from coloured PET flakes of any shade with the aid of a detection in the visible region of the electromagnetic spectrum
- The separation of coloured PET flakes of any shade from clear and/or light-blue PET flakes with the aid of a detection in the visible region of the electromagnetic spectrum
- The separation of brown PET flakes from clear and/or coloured PET flakes of any shade except for brown with the aid of a detection in the visible region of the electromagnetic spectrum
- The separation of PET flakes from flakes of another polymeric material (e.g. PE, PP, PVC (polyvinyl chloride), PS (polystyrene), PC (polycarbonate) or PLA (polylactic acid)) with the aid of a detection in the IR region of the electromagnetic spectrum
- The separation of PE flakes from PP flakes with the aid of a detection in the IR region of the electromagnetic spectrum.

EXAMPLE 1

1000 kg/h PET flakes consisting of 80% clear flakes and 20% coloured flakes were supplied to a sorting device according to FIG. 3. As a result of the returns, there was a throughput of 1950 kg/h with a colour component of 19.4% at the sorting device (S1). With a sorting efficiency of 88% and a rejection error rate of 60%, a major fraction of 1119 kg/h with a colour component of 4.2% and a minor fraction of 832 kg/h with a colour component of 40% were obtained.

There was a throughput of 1213 kg/h with a colour component of 4.1% at the sorting device (S2). With a sorting efficiency of 90% and a rejection error rate of 90%, a major fraction of 762 kg/h with a colour component of 0.66% and a minor fraction of 451 kg/h with a colour component of 10% were obtained.

There was a throughput of 762 kg/h at the sorting device (S4). With a sorting efficiency of 95% and a rejection error rate of 95%, a major fraction of 667 kg/h with a colour component of 0.038% and a minor fraction of 95 kg/h with a colour component of 5% were obtained.

There was a throughput of 832 kg/h at the sorting device (S3). With a sorting efficiency of 60% and a rejection error rate of 40%, a major fraction of 499 kg/h with a colour component of 26.7% and a minor fraction of 333 kg/h with a colour component of 60% were obtained.

The overall loss of clear flakes was therefore 133 kg/h or 16.6% of the supplied clear flakes.

COMPARATIVE EXAMPLE 1

1000 kg/h PET flakes consisting of 80% clear flakes and 20% coloured flakes were supplied to a sorting device according to FIG. 6.

As a result of the returns, there was a throughput of 1679 kg/h with a colour component of 18.3% at the sorting device (S1).

With a sorting efficiency of 88% and a rejection error rate of 60%, a major fraction of 1003 kg/h with a colour component of 3.7% and a minor fraction of 677 kg/h with a colour component of 40% were obtained.

There was a throughput of 1003 kg/h at the sorting device (S2). With a sorting efficiency of 90% and a rejection error rate of 90%, a major fraction of 671 kg/h with a colour component of 0.55% and a minor fraction of 332 kg/h with a colour component of 10% were obtained.

There was a throughput of 671 kg/h at the sorting device (S4). With a sorting efficiency of 95% and a rejection error rate of 95%, a major fraction of 601 kg/h with a colour component of 0.032% and a minor fraction of 70 kg/h with a colour component of 5% were obtained.

There was a throughput of 1079 kg/h with a colour component of 28.5% at the sorting device (S3). With a sorting efficiency of 65% and a rejection error rate of 50%, a major fraction of 680 kg/h with a colour component of 15.8% and a minor fraction. of 339 kg/h with a colour component of 50% were obtained. The loss of clear flakes was therefore 199 kg/h or 24.9% of the supplied clear flakes.

Here, the advantage of the device according to the invention can be seen in the significantly lower loss of good product (clear flakes). This is mainly the result of the lower throughput and the higher colour component during sorting in sorting device (S3).

EXAMPLE 2

1000 kg/h PET flakes consisting of 80% clear flakes and 20% coloured flakes were supplied to a sorting device according to FIG. 3.

As a result of the returns, there was a throughput of 2004 kg/h with a colour component of 17.9% at the sorting device (S1). With a sorting efficiency of 90% and a rejection error rate of 65%, a major fraction of 1083 kg/h with a colour component of 3.3% and a minor fraction of 921 kg/h with a colour component of 35% were obtained.

There was a throughput of 1159 kg/h with a colour component of 3.4% at the sorting device (S2). With a sorting efficiency of 92% and a rejection error rate of 92%, a major fraction of 712 kg/h with a colour component of 0.44% and a minor fraction of 447 kg/h with a colour component of 8% were obtained.

There was a throughput of 712 kg/h at the sorting device (S4). With a sorting efficiency of 97% and a rejection error rate of 96%, a major fraction of 636 kg/h with a colour component of 0.015% and a minor fraction of 76 kg/h with a colour component of 4% were obtained.

There was a throughput of 921 kg/h at the sorting device (S3). With a sorting efficiency of 62% and a rejection error rate of 45%, a major fraction of 558 kg/h with a colour component of 22% and a minor fraction of 363 kg/h with a colour component of 55% were obtained. The loss of clear flakes was therefore 164 kg/h or 20.5% of the supplied clear flakes.

Here, the flexibility of the device according to the invention is demonstrated as a further advantage. The good product quality can be significantly improved while the good product loss still is low.

EXAMPLE 3

1000 kg/h PET flakes consisting of 70% clear flakes and 30% coloured flakes were supplied to a sorting device according to FIG. 3.

As a result of the returns, there was a throughput of 2227 kg/h with a colour component of 28.8% at the sorting device (S1). With a sorting efficiency of 85% and a rejection error rate of 55%, a major fraction of 1017 kg/h with a colour component of 9.4% and a minor fraction of 1210 kg/h with a colour component of 45% were obtained.

There was a throughput of 1161 kg/h with a colour component of 9.1% at the sorting device (S2). With a sorting efficiency of 90% and a rejection error rate of 80%, a major fraction of 683 kg/h with a colour component of 1.55% and a minor fraction of 478 kg/h with a colour component of 20% were obtained.

There was a throughput of 683 kg/h at the sorting device (S4). With a sorting efficiency of 95% and a rejection error rate of 93%, a major fraction of 539 kg/h with a colour component of 0.098% and a minor fraction of 144 kg/h with a colour component of 7% were obtained.

There was a throughput of 1210 kg/h at the sorting device (S3). With a sorting efficiency of 55% and a rejection error rate of 35%, a major fraction of 749 kg/h with a colour component of 32.7% and a minor fraction of 461 kg/h with a colour component of 65% were obtained.

The loss of clear flakes was therefore 161 kg/h or 23% of the supplied clear flakes.

COMPARATIVE EXAMPLE 2

1000 kg/h PET flakes consisting of 70% clear flakes and 30% coloured flakes were supplied to a sorting device according to FIG. 6.

As a result of the returns, there was a throughput of 1838 kg/h with a colour component of 27.2% at the sorting device (S1). With a sorting efficiency of 85% and a rejection error rate of 55%, a major fraction of 894 kg/h with a colour component of 8.4% and a minor fraction of 944 kg/h with a colour or of 45% were obtained.

There was a throughput of 894 kg/h at the sorting device (S2). With a sorting efficiency of 90% and a rejection error rate of 80%, a major fraction of 557 kg/h with a colour component of 1.35% and a minor fraction of 337 kg/h with a colour component of 20% were obtained.

There was a throughput of 557 kg/h at the sorting device (S4). With a sorting efficiency of 95% and a rejection error rate of 93%, a major fraction of 455 kg/h with a colour component of 0.082% and a minor fraction of 102 kg/h with a colour component of 7% were obtained.

There was a throughput of 1383 kg/h with a colour component of 36% at the sorting device (S3). With a sorting efficiency of 60% and a rejection error rate of 45%, a major fraction of 838 kg/h with a colour component of 23.8% and a minor fraction of 545 kg/H with a colour component of 55% were obtained.

The loss of clear flakes was therefore 245 kg/h or 35% of the supplied clear flakes.

The advantage of the device according to the invention with a significantly lower loss of clear flakes is even more pronounced at higher inlet concentration.

What is claimed is:

1. Device for obtaining a material from a mixed fraction (M), which comprises particles of the desired material and particles of at least one further material with different optical properties than the desired material, said device comprising a first sorting apparatus (S1) with at least two outlet openings (5, 6) for particles separated from one another, wherein at least two further sorting apparatuses (S2, S3) with at least two outlet openings (5, 6) for particles separated from one another are located downstream of the first sorting apparatus (S1), wherein an outlet opening (5) of the first sorting apparatus (S1), for receiving a major fraction (H1), is connected to the inlet opening of a first further sorting apparatus (S2), an outlet opening (6) of the first sorting apparatus (S1), for receiving a minor fraction (N1), is connected to the inlet opening of a second further sorting apparatus (S3), an outlet opening (6) of a first further sorting apparatus (S2), for receiving a minor fraction (N2), is connected to the inlet opening of the first sorting apparatus (S1) and an outlet opening (5) of a second further sorting apparatus (S3), for receiving a major fraction (H3), is connected to the inlet opening of the first sorting apparatus (S1).

2. Device according to claim 1, wherein three further sorting apparatuses (S2, S3, S4) are located downstream of the first sorting apparatus (S1), wherein an outlet opening (5) of the first further sorting apparatus (S2), for receiving a major fraction (H2), is connected to the inlet opening of the third further sorting apparatus (S4) and an outlet opening (6) of the third further sorting apparatus (S4), for receiving a minor fraction (N4), is connected to the inlet opening of the first further sorting apparatus (S2).

3. Device according to claim 1, wherein three further sorting apparatuses (S2, S3, S4) are located downstream of the first sorting apparatus (S1), wherein an outlet opening (5) of the first further sorting apparatus (S2), for receiving a major fraction (H2), is connected to the inlet opening of the third further sorting apparatus (S4) and an outlet opening (6) of the third further sorting apparatus (S4), for receiving a minor fraction (N4), is connected to the inlet opening of the second further sorting apparatus (S3).

4. Device according to claim 1, wherein three further sorting apparatuses (S2, S3, S4) are located downstream of the first sorting apparatus (S1), wherein an outlet opening (5) of the first further sorting apparatus (S2), for receiving a major fraction (H2), is connected to the inlet opening of the third further sorting apparatus (S4), and an outlet opening (6) of the third further sorting apparatus (S4), for receiving a minor fraction (N4), is connected to the inlet opening of the first sorting apparatus (S1).

5. Device according to claim 1, wherein the first sorting apparatus (S1) and the at least two further sorting apparatuses (S2, S3, S4) comprise:

an inlet region (1) with at least one inlet opening for receiving the mixed fraction and an acceleration device for accelerating the particles of the mixed fraction, a detection region (2) with at least one radiation source (2*a*), at least one detector (2*c*) for identifying the radiation reflected by the particles and a data processing unit (3) for evaluating the detected radiation, a separation region (4) for separating the particles of the desired material from particles of the further material, with a deflection device (4*a*) for selectively deflecting the particles of the further material on the basis of the detected radiation.

6. Device according to claim 5, wherein one or more or all sorting apparatuses (S1, S2, S3, S4) comprise a buffer space between inlet opening and acceleration device.

7. Device according to claim 5, wherein one or more or all sorting apparatuses (S1, S2, S3, S4) comprise a metering device between inlet opening and acceleration device.

8. Device according to claim 5, wherein one or more or all sorting apparatuses (S1, S2, S3, S4) comprise a filter between the radiation source and the detector.

9. Method for obtaining a material from a mixed fraction (M), which comprises particles of the desired material and particles of at least one further material with different optical properties than the desired material, said method comprising the following steps:

a) removing particles of the further material from particles of the desired material in a first sorting apparatus (S1), obtaining a major fraction (H1) and a minor fraction (N1) in the process;

b) transferring the major fraction (H1) into a first further sorting apparatus (S2) and transferring the minor fraction (N1) into a second further sorting apparatus (S3);

c) removing particles of the further material from particles of the desired material in a first further sorting apparatus (S2), obtaining a second major fraction (H2) and a second minor fraction (N2) in the process;

d) removing particles of the further material from particles of the desired material in a second further sorting apparatus (S3), obtaining a third major fraction (H3) and a third minor fraction (N3) in the process;

e) returning the second minor fraction (N2) and the third major fraction (H3) to the mixed fraction (M) or directly transferring these fractions (N2, H3) into the first sorting apparatus (S1).

10. Method according to claim 9, wherein the second major fraction (H2) is extracted as desired product.

11. Method according to claim 9, wherein the second major fraction (H2) is transferred to a third further sorting apparatus (S4) and there particles of the further material are removed from particles of the desired material, obtaining a fourth major fraction (H4) and a fourth minor fraction (N4) in the process, wherein the fourth major fraction (H4) is extracted as desired product.

12. Method according to claim 11, wherein the fourth minor fraction (N4) is either added to the first major fraction (H1) and together with the latter transferred to the first further sorting apparatus (S2) or else transferred directly to said first further sorting apparatus (S2).

13. Method according to claim 11, wherein the fourth minor fraction (N4) is either added to the first minor fraction (N1) and together with the latter transferred to the second further sorting apparatus (S3) or else transferred directly to said second further sorting apparatus (S3).

14. Method according to claim 11, wherein the fourth minor fraction (N4) is either added to the mixed fraction (M) and together with the latter transferred to the first sorting apparatus (S1) or else transferred directly to said first sorting apparatus (S1).

15. Method according to claim 9, wherein the mixed fraction (M) comprises ground polymeric material.

16. Method according to claim 15, wherein said polymeric material is selected from the group consisting of ground materials from containers or films of polyethylene, polypropylene, polyethylene terephthalate, and mixtures thereof.

17. Method according to claim 9, wherein 90% or more of the particles of the mixed fraction (M) have a particle size of more than 2 mm.

18. Method according to claim 9, wherein the mixed fraction (M) consists of 50 to 90% particles of the desired material and 10 to 50% particles of at least one further material.

19. Method according to claim 9, wherein the major fraction (H2, H4) extracted as desired product (P) contains less than 1000 ppm particles of the minor fraction (N2, N4).

* * * * *